United States Patent [19]

Buchholz et al.

[11] 4,212,700

[45] Jul. 15, 1980

[54] LABELING STATION

[75] Inventors: Rainer Buchholz; Rudolf Zodrow, both of Düsseldorf; Reinhard Lohse, Haan, all of Fed. Rep. of Germany

[73] Assignee: Jagenberg Werke AG, Düsseldorf, Fed. Rep. of Germany

[21] Appl. No.: 924,786

[22] Filed: Jul. 14, 1978

[30] Foreign Application Priority Data

Sep. 9, 1977 [DE] Fed. Rep. of Germany ..... 2740575

[51] Int. Cl.[2] ..... B65C 9/12

[52] U.S. Cl. ..... 156/568; 156/497; 156/571; 156/DIG. 30; 271/33; 271/276

[58] Field of Search ..... 156/497, 567, 568, 571, 156/578; 118/220, 231; 271/33, 97, 276

[56] References Cited

U.S. PATENT DOCUMENTS

| | | | |
|---|---|---|---|
| 2,626,074 | 1/1953 | Vogt | 156/571 |
| 3,096,977 | 7/1963 | Winkler et al. | 271/276 X |
| 3,379,601 | 4/1968 | Pagay | 156/571 |
| 3,859,155 | 1/1975 | Dullinger | 156/568 X |
| 4,127,265 | 11/1978 | Wirz et al. | 271/276 X |

*Primary Examiner*—Michael G. Wityshyn

*Attorney, Agent, or Firm*—Sprung, Felfe, Horn, Lynch & Kramer

[57] ABSTRACT

A labeling station has a rotating gripper cylinder having gripper elements equally spaced therearound to define label divisions and a carrier rotating in the same sense bearing pickup elements thereon mounted for either rotary or rocking movement in a contrary sense with respect to the carrier during the label transfer. The movement is controlled such that the receiving surfaces of the pickup elements roll at least in the forward area against the gripper cylinder surface when the gripper cylinder rotates. The arc length of the receiving surface of each pickup element is greater than the arc length of each label division of the gripper cylinder and the trailing portion of each label is lifted by at least one of the slip surfaces on the front edges of the pickup elements and blow nozzles associated with the gripper elements on the gripper cylinder. Each pickup element is controlled in its movement during the transfer of the trailing label area exceeding the label division of the gripper cylinder to lift away its receiving surface from the gripper cylinder surface.

3 Claims, 2 Drawing Figures

LABELING STATION

BACKGROUND

The invention concerns a labeling station having a rotating gripper cylinder and a pickup element carrier rotating in the same sense whose contrary rotary or rocking movement in the transfer of labels is controlled such that its receiving surface rolls at least in its forward area on the gripper cylinder surface as the gripper cylinder revolves.

In a known labeling station of this kind (DT-AS 2,325,244), the receiving surfaces are first coated with glue at a glue roll. Then with their glue-coated receiving surface they pick up a label from a stack of labels and transfer it to the gripper cylinder. The pickup elements are driven by a planetary gear drive which consists of a stationary sun gear and a pinion associated with each pickup element. To satisfy the requirement that the receiving surface will roll at the various stations, such as the glue roll, the flat front of the label stack and the gripper cylinder, the pickup elements are journaled between the pickup surface and its center of curvature and each element has a cam-controlled equalizing drive. This equalizing drive consists of a steep-threaded spindle with a threaded sleeve mounted thereon and bearing the pinion. By the axial displacement of the threaded sleeve according to the configuration of the stationary cam, the self rotation of each pickup element, which is produced by the planetary gear drive, is accelerated or retarded.

With this known labeling station and other known labeling stations, only those labels can be used whose length, corresponding to the arc length of the receiving surface of a pickup element, is not greater than the arc length of the division of the gripper cylinder. Longer labels, after transfer to the gripper cylinder, would overlap the gripper elements for the next label to be applied and thus would interfere with the transfer of this label.

THE INVENTION

The object of the invention is to improve a labeling station of the kind mentioned in the beginning so as to enable it to be used with labels whose length is greater than the division of the gripper cylinder.

This object is achieved in accordance with the invention by the fact that the arc length of the receiving surface of each pickup element is greater than the arc length of the division of the gripper cylinder, and that means are provided on the gripper elements or on the leading edges of the pickup means, which lift the trailing area of the label taken from the gripper cylinder away from the gripper elements for the next label to be taken, and that in the transfer of the trailing label area extending beyond the division of the gripper cylinder, the rotary or rocking movement of each pickup element is controlled such that its receiving surface lifts away from the gripper cylinder surface.

Preferably, the means on the leading edges of the pickup elements are slip surfaces by which the trailing label areas are pushed back upon the rotary and rocking movement of the pickup elements. Alternatively or additionally, the means can also be blowing nozzles on the gripper cylinders, associated with the gripper elements.

On account of the special rotational relationships between the gripper cylinder, the pickup element carrier and the pickup elements, the carrier with the pickup elements is not dependent upon the division of the gripper cylinder, so that, with a compact construction of the carrier and a small number of pickup elements, label lengths can be used which are longer than the division of the gripper cylinder. The special rotational relationships in conjunction with the means for pushing away the trailing portion of the label assure that a label can be transferred to the gripper elements without crumpling the trailing, projecting portion of the label already transferred to the gripper cylinder. By the control of the rotation of the pickup elements it is brought about that the portion of the label that projects over the next gripper element is not pressed against the gripper elements but is left free. The clearing of the gripper element for the next label is especially simple if the leading edge of the pickup element has slip surfaces which act on the trailing portion of the label.

BRIEF DESCRIPTION OF THE DRAWINGS

The invention will be described below with the aid of.

DETAILED DESCRIPTION OF THE INVENTION

Figures 1, 2:
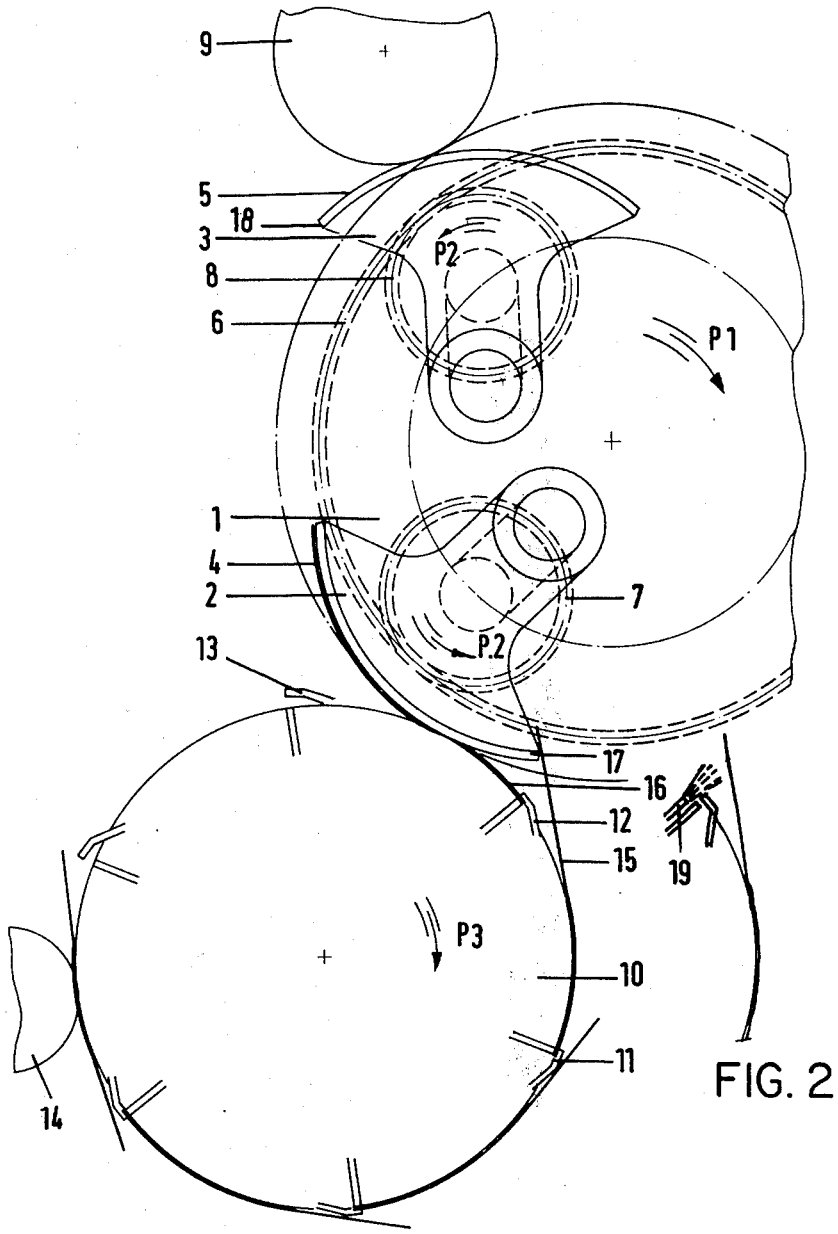
FIG. 1 is a diagrammatic plan view of an example of one embodiment of the invention.
FIG. 2 is a detail of another embodiment of the invention.

Referring to FIG. 1, the labeling station consists of a carrier 1 rotating in the direction of the arrow $P_1$, on which a plurality of pickup elements 2, 3, are journaled between their cylindrically curved receiving surface 4, 5, and their center of curvature. The pickup elements 2, 3, are driven upon the rotation of carrier 1 by a planetary gear drive which consists of a stationary sun gear 6 and a planet gear 7, 8, associated with each pickup element. The self rotation of the pickup elements 2, 3, in the direction of arrow $P_2$, which is produced in this manner, is accelerated and retarded in accordance with the configuration of a stationary cam which is not shown, by means of a cam-controlled equalizing drive, which also is not represented, such as the one known from DT-AS 2,325,244. On the basis of this control of the self rotation of the pickup elements 2, 3, and their journaling between their receiving surface 4, 5, and their center of curvature, the pickup elements can roll in a slip-free manner at differently shaped stations. One of these stations is a rotating glue roll 9, another is a label box presenting a flat face of a stack of labels which is not shown, and another station is a gripper cylinder 10 rotating in the direction of the arrow $P_3$, which is provided with a plurality of gripper elements 11, 12, 13. The objects to be labeled, such as bottles 14, move in a row past the gripper cylinder 10.

The labeling station thus described operates in the following manner:

After the application of glue to the receiving surface 4, 5, the pickup element 2, 3, rolls with its receiving surface against the face of the label stack, picking up the foremost label. This label has a length that is the same as the length of the arc of the receiving surface 4, 5. The leading edge of the label is then introduced into one of the open gripper elements 11, 12, 13, which then close and pull the label away from the receiving surface 4, 5, as it rolls against the gripper cylinder surface. This operation is taking place in FIG. 1 at the gripper elements 12. As it can be seen, the arc length of the receiving surface 4 is substantially longer than the arc length of the division of the gripper cylinder, that is, the distance between two adjacent gripper elements. Thus the label which has been fully transferred to the gripper cylinder 10 at gripper elements 11, overlaps the gripper elements 12 for the next label 16. However, the receiving surface 4, 5 does not roll against the gripper cylinder during the transfer of the trailing portion of label 15, but instead is lifted away, the label does not lie closely against the gripper cylinder surface, so that the leading edge of the pickup element with the slip surface 17, 18, can engage the trailing portion of the label 15 and lift it further away. Thus, the gripper elements 12 serving for the capture of the next label 16 are clear and able to grip it. Since the carrier 1 and the gripper cylinder 10 are rotating in the same sense but moving contrary to one another in the transfer area and the rotary or rocking movement of the pickup element 2, 3, is contrary to the movement of the carrier 1, the lifting away of the trailing portion of the label takes place without any crumpling.

As shown in FIG. 2, the lifting action can take place by itself or can be assisted by associating blow nozzles 19 with the gripper elements 11, 12, 13 on the gripper cylinder 10, which just before the next label is taken, blow away the trailing area of the label that has already been gripped.

It will be appreciated that the instant specification and claims are set forth by way of illustration and not limitation, and that various changes and modifications may be made thereto without departing from the spirit and scope of the present invention.

What is claimed is:

1. In a labeling station with a rotating gripper cylinder having gripper elements equally spaced therearound to define label divisions and a carrier rotating in the same sense bearing pickup elements thereon mounted for one of rotary or rocking movement in a contrary sense with respect to the carrier during the label transfer and which movement is controlled such that the receiving surfaces of the pickup elements roll at least in the leading area thereof against the gripper cylinder surface during rotation of the gripper cylinder, the improvement comprising: the arc length of the receiving surface of each pickup element being greater than the arc length of each label division of the gripper cylinder, means disposed on at least one of the gripper cylinder or the leading edges of the pickup elements for lifting the trailing portion of the label taken by the gripper cylinder away from the succeeding gripper elements to clear same for the next label to be taken, and means controlling each pickup element movement during the transfer of the trailing label area exceeding the label division of the gripper cylinder to lift away its receiving surface from the gripper cylinder surface.

2. Labeling station according to claim 1, wherein the means on the leading edges of the pickup elements for lifting the trailing portion of the label comprises slip surfaces by which the trailing label areas are pushed back upon the movement of the pickup elements.

3. Labeling station according to claim 1, wherein the means on the gripper elements for the lifting away of the trailing portion of the label comprises blow nozzles which are associated with the gripper elements on the gripper cylinder.

* * * * *